US006776197B1

(12) United States Patent
DeCrane

(10) Patent No.: US 6,776,197 B1
(45) Date of Patent: Aug. 17, 2004

(54) METHOD AND APPARATUS FOR A TRAVERSING FILLER SPOUT FOR SOLID BULK BAG FILLING STATION

(76) Inventor: Charles E. DeCrane, 1057 Hwy. 80 East, Monroe, LA (US) 71203

( * ) Notice: Subject to any disclaimer, the term of this patent is extended or adjusted under 35 U.S.C. 154(b) by 16 days.

(21) Appl. No.: 10/242,919

(22) Filed: Sep. 12, 2002

(51) Int. Cl.[7] ..... B65B 1/04; B65B 3/04

(52) U.S. Cl. ..... 141/10; 141/163; 141/168; 141/176; 141/314; 53/469; 53/570

(58) Field of Search ..... 141/10, 114, 163, 141/166, 168, 171, 173, 176, 313–316; 53/468, 469, 473, 284.7, 570

(56) References Cited

U.S. PATENT DOCUMENTS

| | | | | |
|---|---|---|---|---|
| 4,676,284 A | | 6/1987 | DeCrane | |
| 4,964,782 A | | 10/1990 | DeCrane | |
| 5,033,935 A | | 7/1991 | Decrane | |
| 5,036,893 A | | 8/1991 | DeCrane | |
| 5,056,571 A | * | 10/1991 | Derby | 141/114 |
| 5,400,837 A | * | 3/1995 | Kelley et al. | 141/10 |
| 5,787,945 A | | 8/1998 | Riemersama | |
| 6,089,283 A | * | 7/2000 | Sienerth et al. | 141/75 |
| 6,149,110 A | | 11/2000 | Gill et al. | |
| 6,564,534 B2 | * | 5/2003 | Poulton et al. | 53/570 |

* cited by examiner

*Primary Examiner*—Timothy L. Maust
(74) *Attorney, Agent, or Firm*—Robert N. Montgomery

(57) ABSTRACT

A bulk bag-filling machine with a traversing strap latching and traversing filler spout mechanisms. The strap latch mechanisms and the filler spout may be moved independently or in unison forwardly towards the front or forward most edge of the filling station, thereby permitting the operator of the filling apparatus to easily and safely suspend the heavy bulk bag's strap loops on the four strap latches and make the filler neck connection to the filling spout prior to traversing the strap latches and filler neck to their rearmost position, thereby positioning the bag for filling. Boxes may also be utilized by the adaptation of transfer tables in which case the strap latches are not required.

12 Claims, 6 Drawing Sheets

METHOD AND APPARATUS FOR A TRAVERSING FILLER SPOUT FOR SOLID BULK BAG FILLING STATION

FIELD OF THE INVENTION

This invention relates generally to bulk bag-filling equipment and more particularly to an improvement to my bag or box filling apparatus disclosed by my U.S. Pat. Nos. 4,676,284 and 5,036,894 and incorporated herein in their entirety by reference. The improvement incorporates a traversing filler spout that permits easy removal and attachment of bulk bags, or box filler neck, by an operator standing adjacent to the bag filling apparatus.

BACKGROUND OF THE INVENTION

Large container bags are currently used for transporting dry bulk materials. Such bags are constructed of reinforced, flexible polymeric materials supported by integral lifting straps and fitted with a filler neck. Bags range in size between 20 and 70 cubic feet and may also be contained in boxes for easy of stacking and transport.

Bag filling apparatus are generally designed in a manner whereby the large bags are suspended from the filling equipment by lifting straps connected to latch bars in a releasable manner with the bag's filler neck connected to the station's filling spout. The bags are usually lowered periodically onto a platform having apparatus for weighing the contents of the bag and vibrating the material therein-eliminating air pockets to insure densification. When the bulk bags are contained in boxes lifting the bags becomes unnecessary. However, connecting the bag's filler neck to the spout remains an awkward task for the operator.

Various methods have been devised to assist the station operator in connecting the bag's lifting straps and/or filler neck to the machine's filer spout in a manner whereby the neck is secured to the filler spout and the bag is held suspended in a fully extended position from the latch bars or in their corrugated boxes ready for filling.

As a result of the weighing and vibrating platform being located directly below the bag or box, the operator finds it very difficult to properly secure the straps and filler neck without stepping on the weighing and vibration platform. In some cases the filling station is also not accessible from either side due to conveying equipment or other machines or the filling apparatus may be located above floor level. Therefore, prior art systems have been disclosed which allow the rear most strap latch bars to move forward towards the operator for loading. However, since the station's filler spout is generally fixed, making up the filler neck connection still places the operator in a strain by requiring the operator to access the filler neck connection from outside the filling station apparatus with the bag in the fully extended position placing the neck central to the loading platform. It is, therefore, an object of this invention to provide a method and apparatus which allows the operator to have full access to the strap latches and filler neck while standing outside the perimeter of the filling apparatus prior to placing the bag in a suspended or fully extended position.

SUMMARY OF THE INVENTION

A bulk bag-filling machine with a traversing strap latching and traversing filler spout mechanisms. The strap latch mechanisms and the filler spout may be moved independently or in sequence forwardly towards the front or forward most edge of the filling station, thereby permitting the operator of the filling apparatus to easily and safely suspend the heavy bulk bag's strap loops on the four strap latches and make the filler neck connection to the filling spout prior to traversing the strap latches and filler neck to their rearmost position, thereby positioning the bag for filling.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
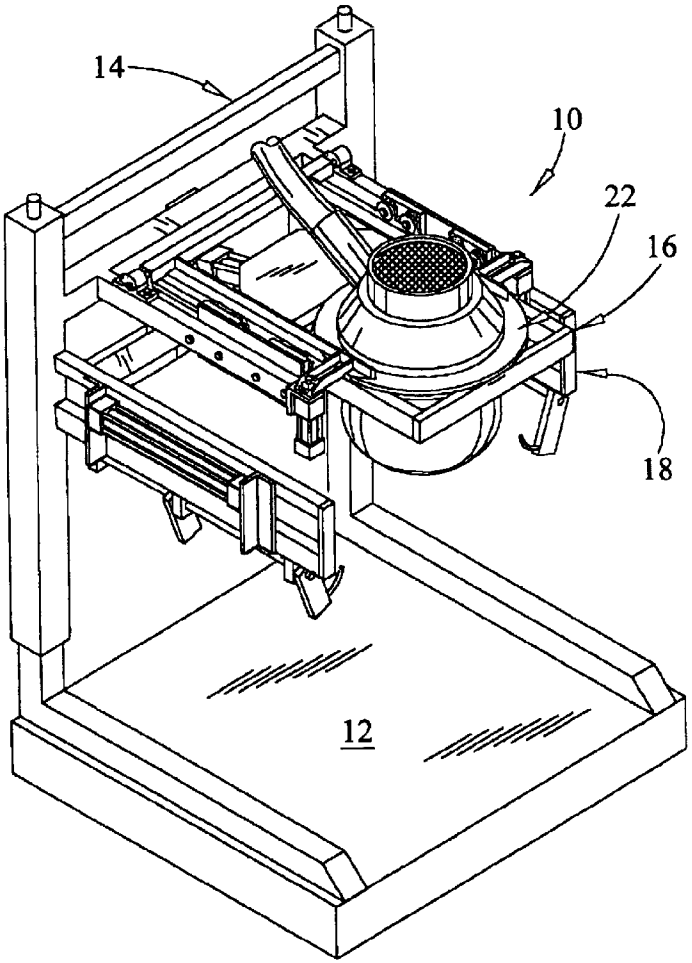
FIG. 1 is an isometric view of the bag filling apparatus with traversing spout in the rear most or fill position.

Looking first at FIG. 1 we see that the bulk bag filling apparatus 10 includes a base platform 12, which may contain load sensing and vibrating equipment, a vertical mast 14 extending upwards from the rear of base platform 12, filling spout carriage 16 and latch bar carriage assembly 18 and a support frame 38 attached perpendicularly to the mast 14 projecting all forwardly in a cantilever manner over the base platform 12.

Figure 2:
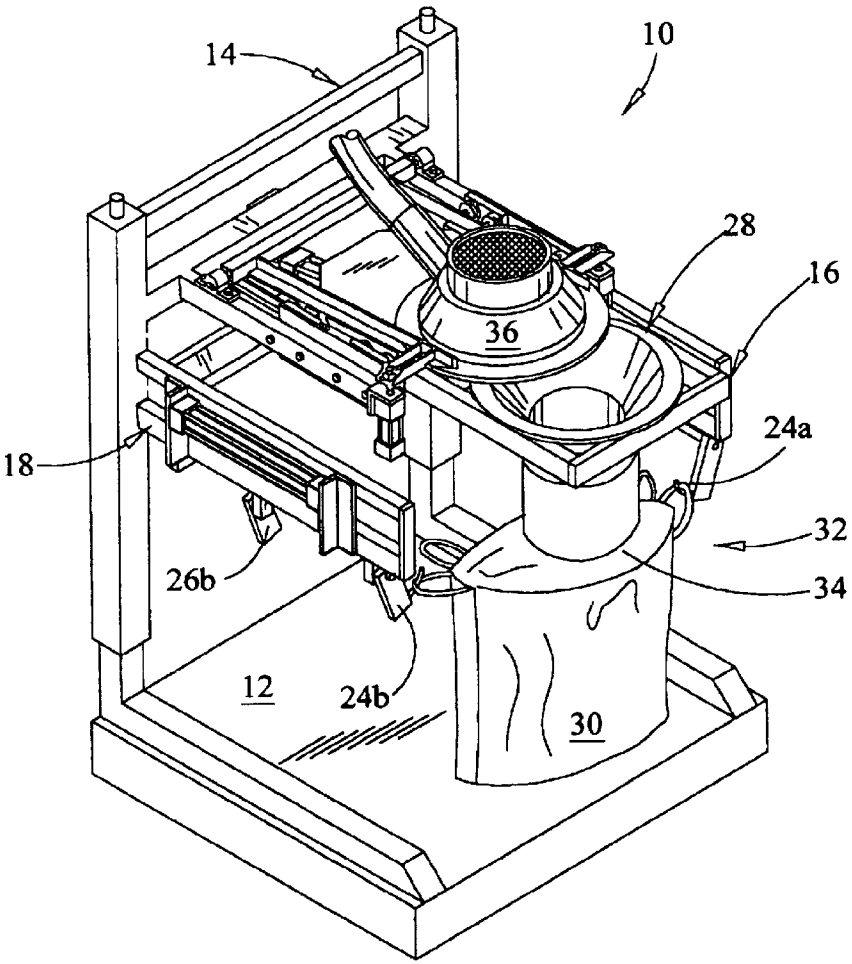
FIG. 2 is an isometric view of the bag filling apparatus in the forward most or bag loading position.
Figure 9:
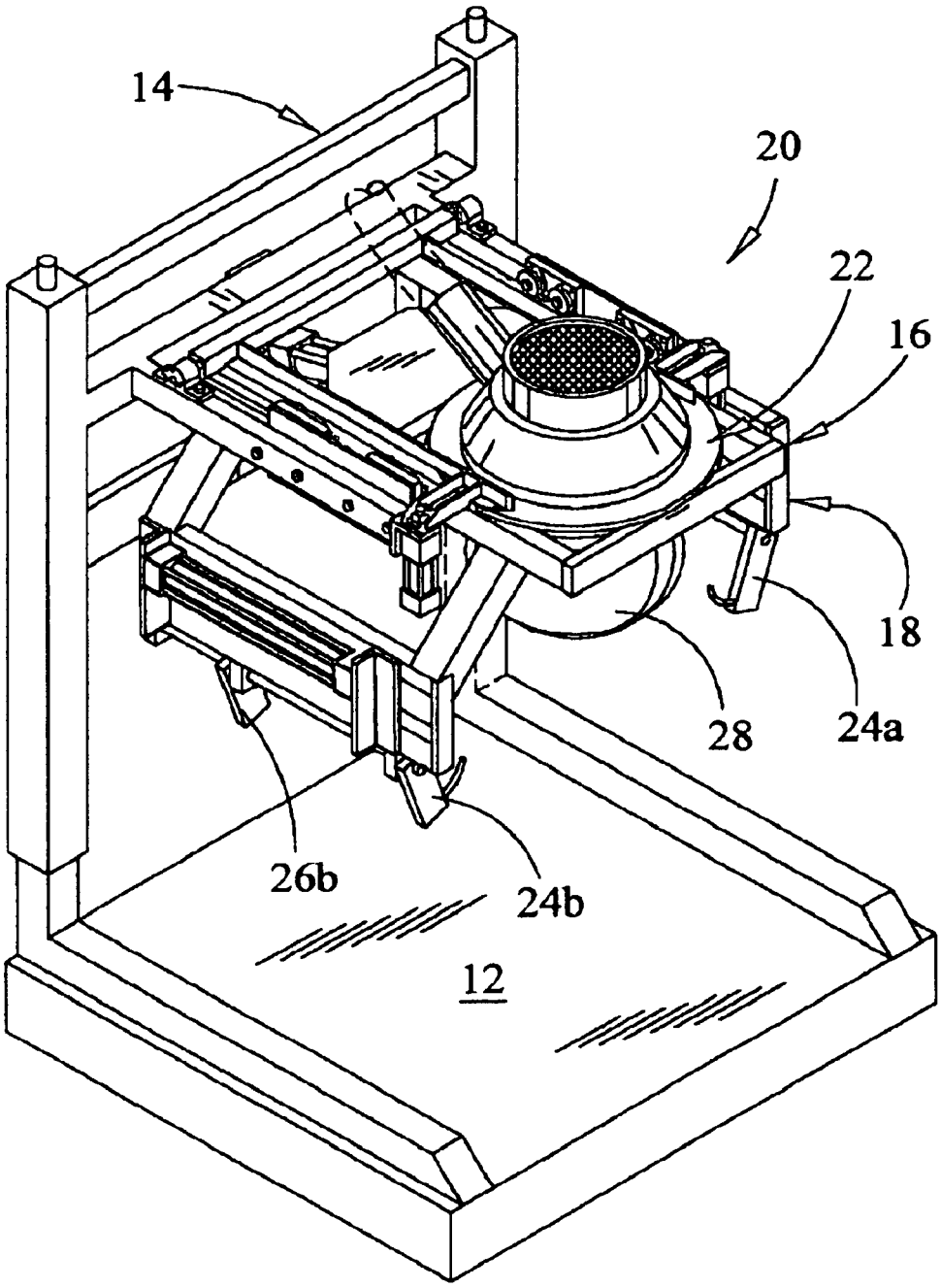
FIG. 9 is an isometric view of a second embodiment of the filling apparatus with the traversing bag loop latching arm apparatus and the traversing filling spout apparatus combined and operated by a single actuator.

The detailed construction of my bulk bag filling station is fully described in my previous U.S. Pat. Nos. 4,676,284 and 5,036,894 and incorporated herein by reference. The improvements disclosed herein are related primarily to the combining of the new traversing filling spout assembly 16 and its support frame 38 which may include the traversing latch assembly 18 utilized in my prior art patents As seen in FIG. 2 or as a combination unit as illustrated in FIG. 9.

Figure 3:
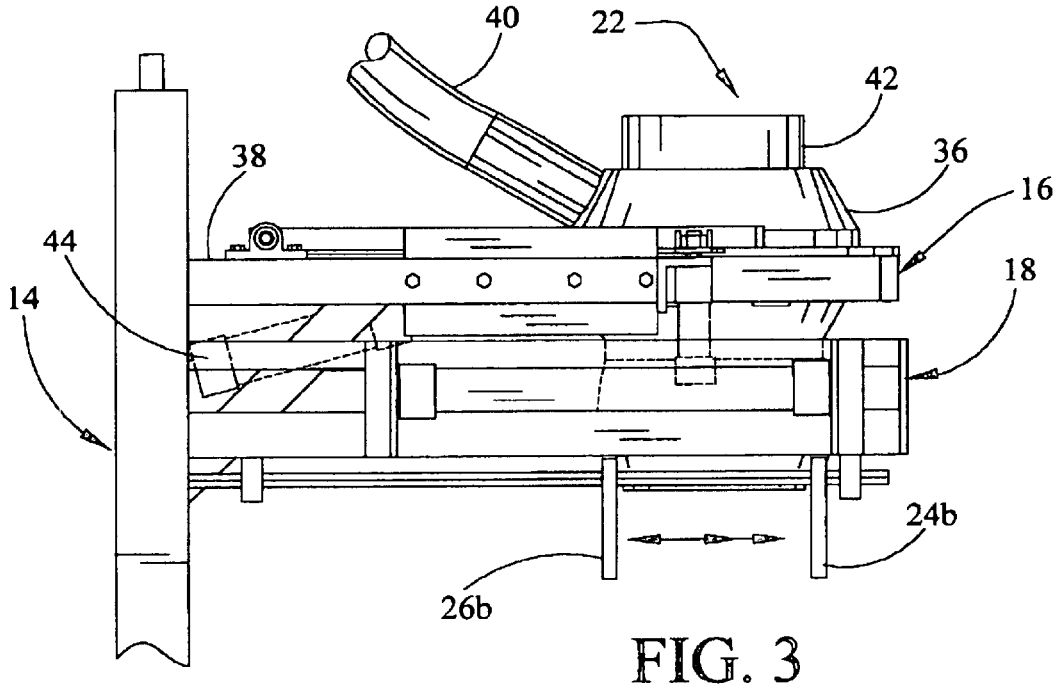
FIG. 3 is a side partial elevation view of the apparatus as seen in FIG. 1.

As seen in greater detail in FIG. 3, the filler plenum or spout assembly 22 is supported by carriage assembly 16 and is shown supported by a pair of horizontal frame members 38 fixed to the vertical mast 14. A flexible in-feed line 40 is connected to the upper portion 36 of the filler plenum assembly 22 that includes a filter and vent assembly 42. The carriage assembly 16 is projected forward to a bag attachment position and retracted rearward to a bag filling position by a cylinder 44 pivotally attached at its base to the mast 14 and at its rod end to the carriage assembly 16.

The traversing latching apparatus 18 as previously described remain virtually unchanged in this embodiment with lifting arms 24*a*, 24*b* positionable forward and the rear lifting arms 26*a*, 26*b* traversable independently of the traversing carriage assembly 16.

Figure 4:
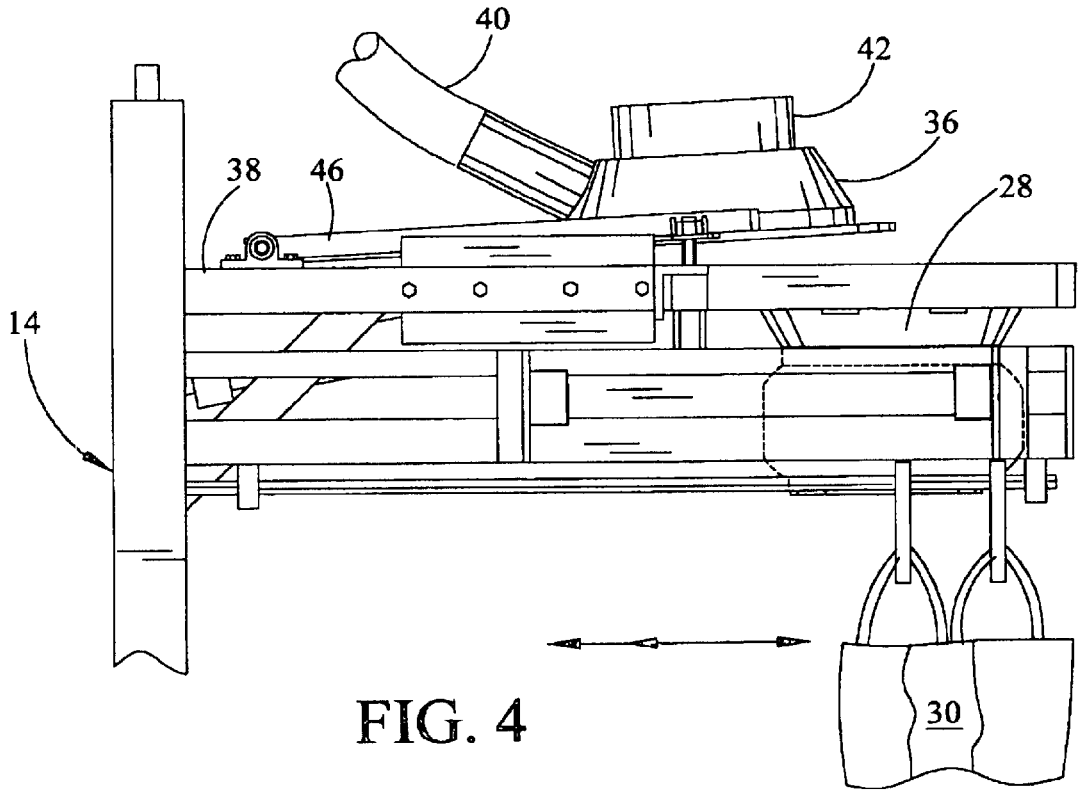
FIG. 4 is a side partial elevation view of the apparatus as seen in FIG. 2.

As further seen in FIG. 4, the upper portion 36 of the filler plenum assembly 22 is mounted to a pair of legs 46 pivotally connected to the upper side of the horizontal support arms 38. A pair of lift cylinders 48 located outboard of the horizontal arms 38 raises and lowers the upper portion of the filler plenum 36 in a pivotal manner to allow the carriage assembly, containing the lower or spout portion 28 of the filler plenum assembly 22, to traverse. The lift cylinders 48 further serve to clamp the upper filler plenum portion 36 to the lower plenum or spout portion 28 in a sealing manner. This allows the spout portion 28 to be aligned over the bag in a collapsed condition. Therefore, the bag's loops and its filler neck can be easily accessed from the leading edge of the loading apparatus 10.

Figure 5:
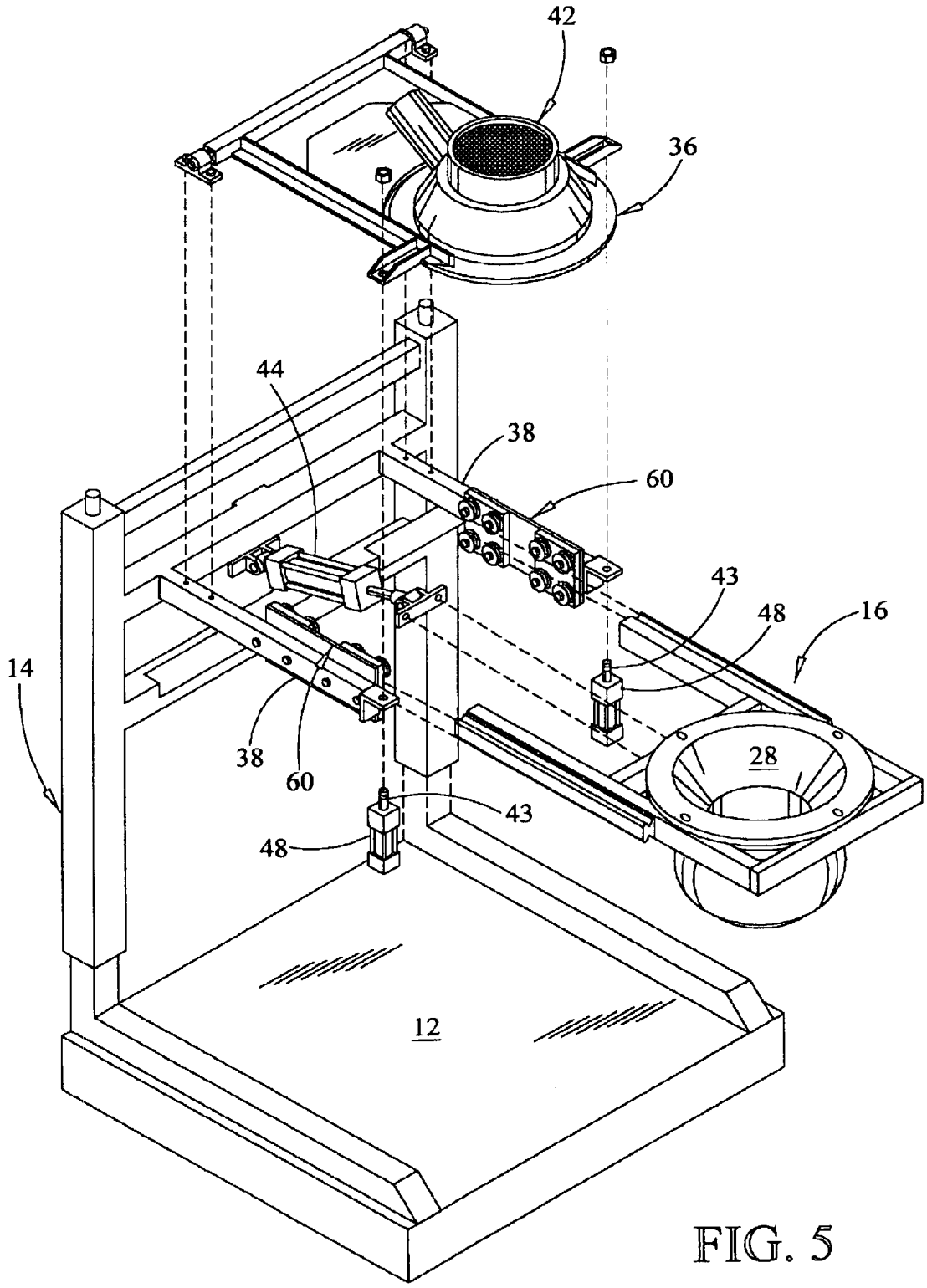
FIG. 5 is partial exploded view of the apparatus as seen in FIG. 2.
Figure 6:
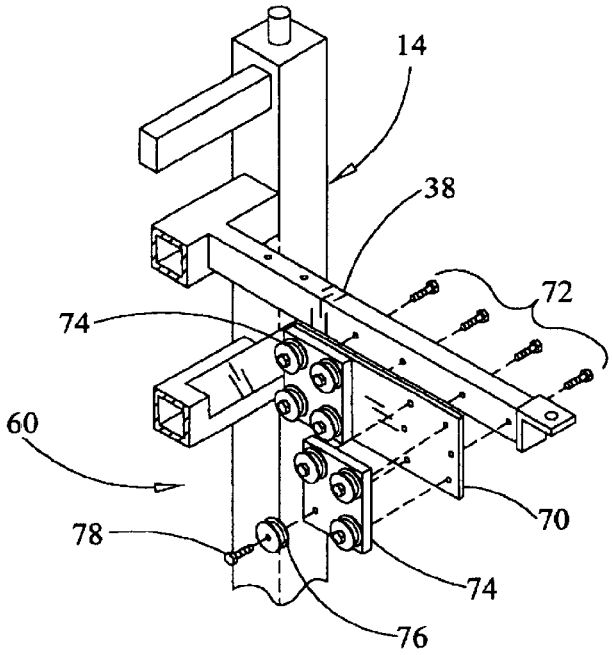
FIG. 6 is an exploded view of the roller guide assembly seen in FIG. 5.

FIG. 5 details how the filler neck and carriage portion 16 is constructed and adapted to the support arms 38, how the cylinders 44 and 48 are connected, how the pivotal mounting of the upper filler plenum portion 36 is achieved, along with a view of the guide roller assembly 60. These assemblies are seen in greater detail in FIGS. 6,7, and 8. The roller guide assembly 60, as seen in FIG. 6, is composed of a base plate 70 attached to the support arm 38 by screws 72 extending through the support arm 38, two roller plates 74 having four rollers 78, each attached to the base plate 70 by a shoulder bolt 78 passing through each of the rollers 78 and roller plate 74, thereby allowing the roller 76 to revolve freely upon the screw 78. Spacing between the upper and lower rollers is fixed to receive the I-Beam rail members 58 seen in FIG. 8.

Figure 7:
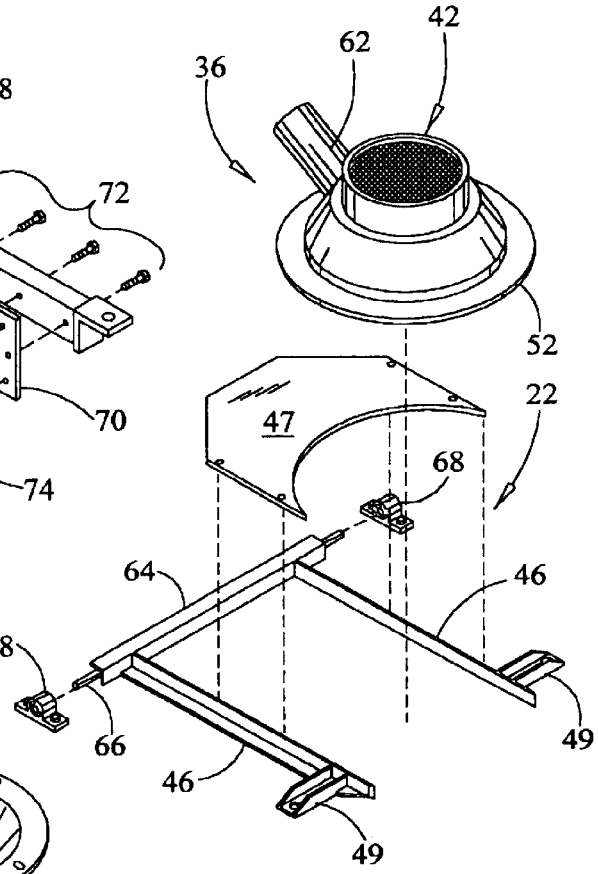
FIG. 7 is an exploded view of a portion of the filler spout assembly seen in FIG. 5.

As illustrated in greater detail in FIG. 7, the pivotal assembly 22 includes the upper portion of the filler plenum 36 and is also a conical tubular member having a wide flange portion 52, an inlet tube 62 intersecting the conical tubular portion at an acute angle, and further includes a filter and vent assembly 42 located within the tubular member opposite the flange 52. The plenum member 36 is supported by the pivotal arms 46 attached to the upper side of the wide flange 52 as seen in FIG. 5. A dust shield 47 is also provided adjacent the flange 52, extending horizontally between the pivotal arms 46. Pivotal arms 46 are connected perpendicularly to a tubular cross member 64 pivotally operable about a shaft 66 and supported at each end by bearings 68 mounted to the upper side of the frame horizontal support arms 38 in the manner illustrated in FIG. 5. A channel member 49 is provided and attached perpendicular to each of the pivotal arms 46 adjacent their connecting points with the upper plenum assembly 36 for engagement with the rod end 43 of the lift cylinders 48 in the manner illustrated in FIG. 4.

Figure 8:
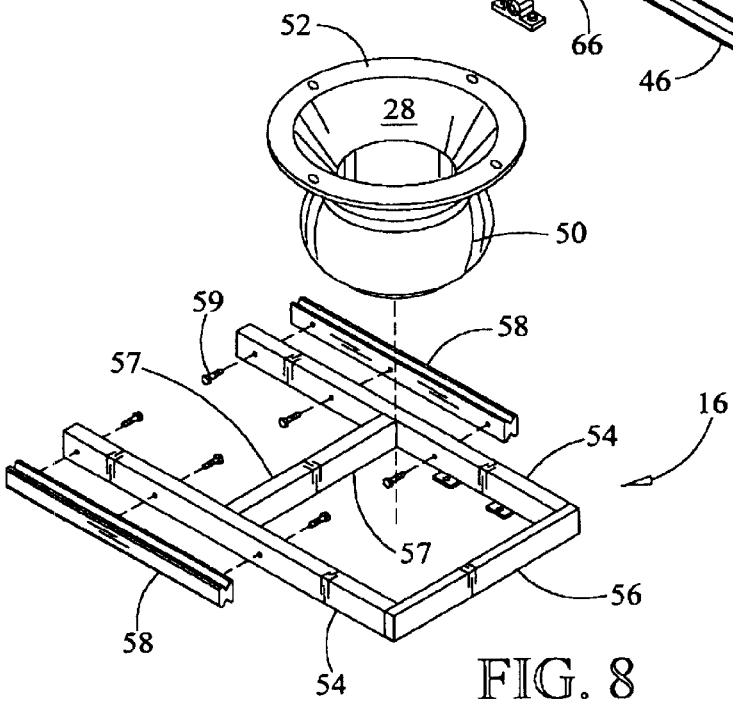
FIG. 8 is an exploded view of a portion of the filler spout and carriage assembly seen in FIG. 5.

The lower plenum or spout portion 28, as seen in FIG. 8, is a conical tubular member consisting of a lower neck portion 50 and a wide upper flange portion 52. The lower neck portion 50 may be fitted with clamping or expanding mechanisms for retaining the bag's filler neck. A pair of rail members 54 supports the filler spout portion 28 of the plenum assembly 22 below the flange 52 and a pair of cross members 56,57 forming a box frame surrounding the neck portion 50. I-beam guide rails 58 are shown removably attached outboard of the rail members 54 by screws 59.

As seen in FIG. 9 the traversing latching apparatus as disclosed in previous U.S. Pat. No. 5,036,893 mentioned above is herein cooperatively attached as a frame unit assembly 18 to the under side of the traversing spout carriage assembly 16, thereby forming a combined traversing carriage assembly 20 that includes a portion of the filler head or plenum assembly 22 seen in FIG. 1 and traverses in a forward and rearward manner as shown in FIG. 2. By traversing the carriage assembly 20 forward, an operator is presented with the fixed forward latching arms 24*a*, 24*b*, rear traversing latching arms 26*a* and 26*b*, extended to their forward most position, and the lower neck or spout portion 28 of the filler plenum assembly 22 at or near the front edge of the base platform 12; thereby making it much easier for the operator standing at floor level to attached the heavy bulk bags 30 by their straps 32 to the latch bars 24*a*, 24*b*, 26*a*(not shown), 26*b*. Traversal of the rear latching arms 26*a*, 26*b* rearwardly deploys the bag 30 as seen in FIG. 2, allowing easy access to and connection of the bag's filler neck 34 to the lower neck portion 28 of the filler plenum 22.

Rearward traversal of the carriage assembly 20 centrally locates the bag 30 relative to the base platform 12 and centrally aligns the lower portion 28 of the filler plenum 22 to the upper plenum portion 36 of the filler plenum 22 where mating of the upper and lower portions 28, 36 of the plenum assembly 22 occurs.

Figure 10:
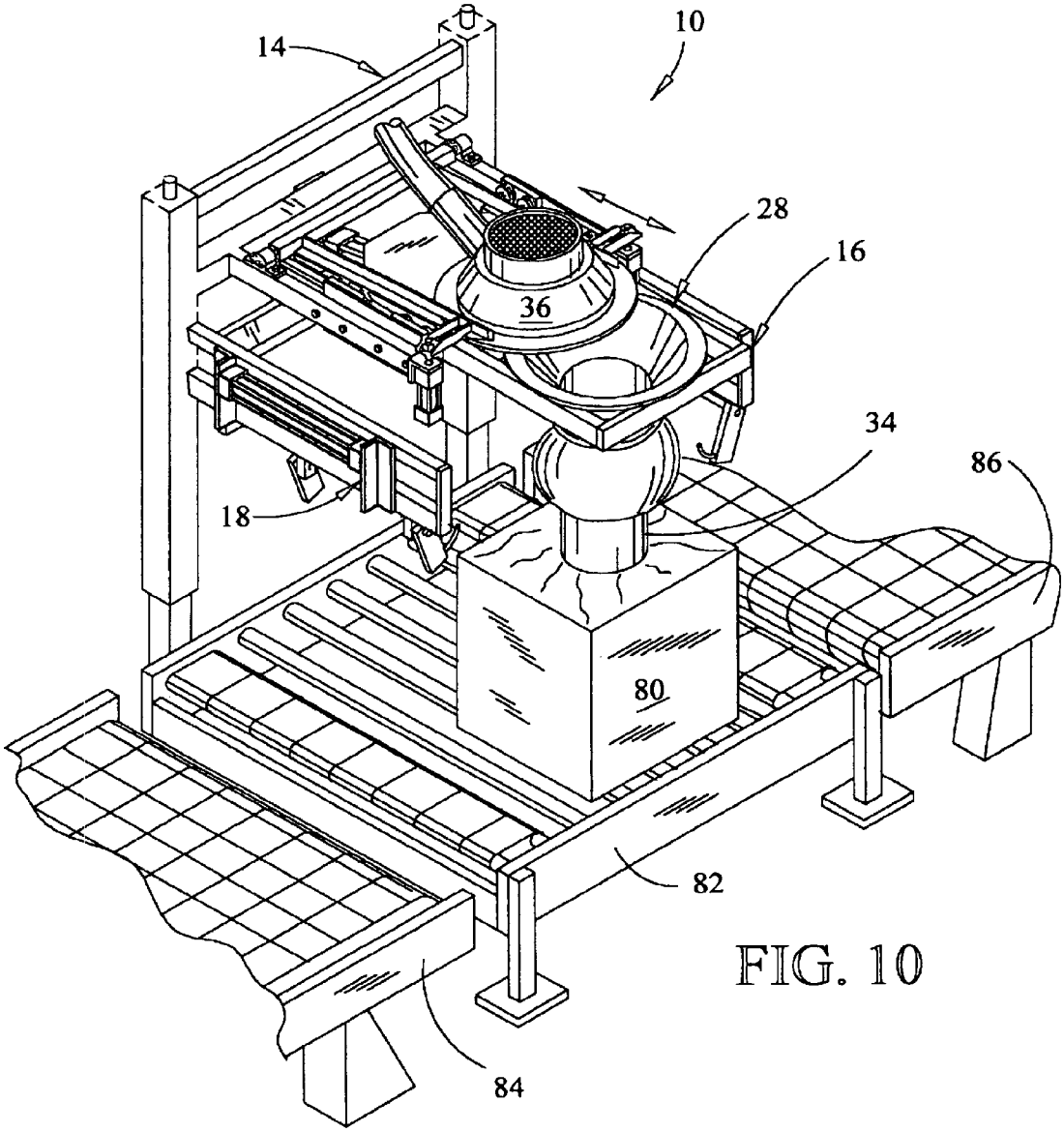
FIG. 10 is an isometric view of the bulk bag filling apparatus illustrated in FIG. 1 configured for handling bulk bag boxes on conveyers.

As further seen in FIG. 10 box type bulk bags 50 may be shuttled forward or rearward on the trundle conveyor having both x any y transfer roller capability to allow the filler neck 34 of the bulk box bags to be aligned and attached to the plenum lower portion 28. Connecting transfer conveyors 56, 58 bring the empty boxes to the filling station and transfer the filled boxes away from the station 10.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A bulk bag filling apparatus comprising:

a) a base;

b) a vertical mast connected to said base;

c) a pair of horizontal frame members attached to and extending perpendicularly from said mast;

d) a filler spout assembly supported by said horizontal frame members;

e) a carriage assembly having at least a lower portion of said filler spout assembly attached thereto supported by and longitudinally traversable relative to said horizontal frame members; and f) a means for positioning said carriage assembly between a first bag attaching position and a second bag filling position relative to said horizontal frame members in a shuttling manner.

2. The bulk bag filling apparatus according to claim 1 wherein said filler spout assembly comprises an upper portion pivotally attached to said horizontal frame members.

3. The bulk bag filling apparatus according to claim 2 wherein said upper portion of said filler spout is positioned between a first position in sealed contact with said lower portion of said filler spout assembly and a second position separated from said lower portion of said filler spout assembly.

4. The bulk bag filling apparatus according to claim 1 wherein said carriage assembly further comprises a means for releaseably holding said bag prior to and during filling.

5. A bulk bag filling apparatus comprising:

a) a bag support base;

b) a vertical frame extending vertically from said base;

c) a pair of horizontal support arms attached perpendicular to said vertical frame located opposite and parallel to said base;

d) a filler spout assembly having an upper portion and a lower portion the upper portion being separateable from said lower portion and pivotally attached to said horizontal support arms;

d) a plurality of rollers attached to each of said support arms;

e) a carriage assembly comprising at least a lower portion of said filler spout assembly and said plurality of rollers for traversing said carriage relative to said horizontal support arms between a bag attachment position and a bag filling position;

f) a means for positioning said upper portion of said filler spout relative to said lower portion of said filler spout; and g) an actuator means for traversing said carriage between said bag attachment position and said bag filling position.

6. The bulk bag filling apparatus according to claim 5 wherein said carriage further comprises a means for releaseably holding said bag prior to and during filling.

7. The bulk bag filling apparatus according to claim 5 wherein said means for traversing said carriage comprises I-beam rails attached to said carriage in cooperative contact with said plurality of rollers attached to said horizontal frame members and said actuator is pivotally attached to said vertical frame and said carriage assembly.

8. The bag filling apparatus according to claim 7 wherein said filler spout assembly having upper and lower portions said upper portion further having an inlet tube, and vent filter assembly and an actuating means attached to said upper portion for separating and sealing said upper portion of said filler spout assembly relative to said lower portion.

9. The bulk bag filling apparatus according to claim 8 wherein said carriage further comprises a means for releaseably holding said bag prior to and during filling.

10. A method of fitting a bulk bag filling apparatus having a base, a support frame and a means for holding and releasing a bulk bag attached to said frame with a linear traveling carriage capable of traversing at least a portion of the filler spout of a bulk materials filling machine between a filling position and a bag attachment position, the steps comprising, fitting said bag filling machine with a linear carriage assembly having at least a lower portion of said filler spout attached thereto, a means for positioning said carriage —from said filling position to said bag attachment position, and reattaching said means for holding and releasing said bulk bag to said liner carriage assembly.

11. The method according to claim 10 further comprising the step of actuating said means for holding said bag said step being independent—from the step of—positioning said carriage assembly.

12. The method according to claim 11 further comprising the step of traversing said carriage and filler spout when filling boxes.

* * * * *